United States Patent [19]

Kim

[11] Patent Number: 4,529,538

[45] Date of Patent: Jul. 16, 1985

[54] ELECTRICALLY CONDUCTIVE POLYMER COMPOSITIONS

[75] Inventor: Oh-Kim Kim, Burke, Va.

[73] Assignee: The United States of America as represented by the Secretary of the Navy, Washington, D.C.

[21] Appl. No.: 521,798

[22] Filed: Aug. 9, 1983

[51] Int. Cl.[3] ..... H01B 1/00

[52] U.S. Cl. ..... 252/500; 524/236; 525/374; 528/492

[58] Field of Search ..... 252/500; 524/236, 560; 525/374; 528/492

[56] References Cited

U.S. PATENT DOCUMENTS

| | | | |
|---|---|---|---|
| 3,162,641 | 12/1964 | Acker et al. | 260/280 |
| 3,679,944 | 7/1972 | Yoshimura et al. | 252/626 |
| 3,679,944 | 7/1972 | Yoshimura et al. | 252/62.6 |
| 3,966,987 | 6/1976 | Suzuki et al. | 252/500 |
| 3,996,987 | 6/1976 | Suzuki et al. | 252/500 |
| 4,293,452 | 10/1981 | Fox et al. | 252/518 |
| 4,359,411 | 11/1982 | Kim et al. | 252/500 |
| 4,374,048 | 2/1983 | Kim et al. | 252/500 |

*Primary Examiner*—Josephine L. Barr

*Attorney, Agent, or Firm*—Robert F. Beers; William T. Ellis; Barry A. Edelberg

[57] ABSTRACT

A conductive polymer composite system is made by dissolving an electron donating polymer and a simple or complex N-methylphenazinium TCNQ salt in a mutual solvent and casting a film of the resulting solution on a suitable substrate.

23 Claims, 5 Drawing Figures

ELECTRICALLY CONDUCTIVE POLYMER COMPOSITIONS

FIELD OF THE INVENTION

The present invention pertains generally to electroactive materials and in particular to organic polymeric conductive materials.

BACKGROUND OF THE INVENTION

Presently, numerous metals and other inorganic substances are used to fabricate electrical conductors, semiconductors, electronic devices, and electromagnetic or acoustic sensors. The utility of these materials is frequently limited by such factors as weight, mechanical fragility, fabrication problems, corrosion, scarcity, and high costs.

Many organic materials have properties which overcome or minimize these problems and possess several other advantages, such as ease of fabrication into films, filaments and complex shapes and variability in molecular design. Of particular importance is the possibility with organic materials to fabricate electronic devices whose dimensions are "molecular", such as diodes, capacitors, and gates whose dimensions are in the range of 10 angstroms to 500 angstroms.

Numerous resinous compositions that conduct electricity are known. Many of them comprise an organic resin with a conductive material, e.g., a metal or graphite, dispersed in a resin. Due to a lack of chemical bonding and the discreteness of the conductive filler, the mechanical properties are not good. For the same reasons, loading the polymeric binder with sufficient filler to produce a polymeric conductor with sufficient conductivity to meet the requirements of many applications is often not possible. Further, metallic corrosion can deteriorate the conductivity of the composition. Metals and graphite are not transparent and their inclusion prevents the fabrication of a transparent conductor.

One type of conductive resin includes radical-anion salts of 7,7,8,8-tetracyanoquinodimethane (TCNQ) which are themselves organic semiconductors. A complex salt, $M^+(TCNQ)_2^{\cdot-}$, is also used and is preferred on account of a higher conductivity than the corresponding simple salt, $M^+TCNQ^{\cdot-}$. The properties of polymeric semiconductors of the polycation-TCNQ type have some advantages over their monomeric derivatives in that they are processable and their conductivity can be controlled by varying the TCNQ concentration. However, the matrix polymer is brittle due to its ionic nature, and its stability is lowered by sensitivity to moisture. Another approach is to disperse TCNQ salts into non-ionic matrix polymers so that advantage can be taken of the mechanical properties and higher stabilities of the polymer. For example, U.S. Pat. No. 3,679,944 relates to the dispersion of TCNQ salts, such as N-methylphenazinium TCNQ in polyamides and cellulose polymers. In that patent, solid N-methylphenazinium TCNQ particles are added to a solution containing the polymer. The patent teaches that the solvent used for dissolving the polymer must not dissolve neutral TCNQ or its salt. Unfortunately, this product still has compatability, stability and dispersion problems.

U.S. Pat. No. 4,374,048, incorporated herein by reference, relates to the incorporation of microcrystals of various TCNQ salts, for example N,N,N-triethylammonium TCNQ complex salt into a poly(vinylacetal) matrix. The composition is prepared by dissolving the polymer, TCNQ and the salt in a mutual solvent, then casting out a film from the solution. While the resulting film has excellent properties, it also has some drawbacks. Most notably, the salts referred to in that patent have a limited solubility in matrix polymers, although somewhat higher solubilization occurs in high electron donor-strength polymer matrices. Thus, the loading capacity of the polymer is limited. Furthermore, the low solubility of these salts can cause crystallization to occur too rapidly when the polymer films are cast and dried. Thus, the crystals tend to be too large and agglomerate, so that it is difficult to form a uniform, interconnecting microcrystal network. To enhance solubility, a relatively strong electron donor-matrix polymer is required. However, the polymer tends to donate an electron to the neutral TCNQ ($TCNQ^\circ$) component of the complex salt. thus destabilizing the complex anion, forming a polymer+ $TCNQ^{\cdot-}$ complex and suppressing microcrystallization. To counteract this destabilization, since only the complex form of that salt is conductive and stable, additional $TCNQ^\circ$ must be added to the polymer solution, forming $(TCNQ)_2^{\cdot-}$. Ideally, the ratio of $TCNQ^\circ/TCNQ^{\cdot-}$ in the polymer is 1.

In U.S. Pat. No. 3,966,987, incorporated herein by reference, an electrically conductive polymer is prepared by dissolving a complex salt of N-methylacridinium and a nitrogen containing organic polymer in a mutual solvent and casting a film from the resulting solution. However, only the complex salt of N-methylacridinium TCNQ is stable and conductive. In contrast, both the simple and complex N-methylphenazinium TCNQ salts used in this invention are stable and conductive, thus allowing both the complex and simple salt to contribute to the conductivity of the final polymer composite. Furthermore, it is not believed that the N-methylacridinium TCNQ/polymer system exhibits the unique and unexpected film morphology exhibited by the present invention. Additionally, nitrogen-containing polymers make poor matrices in the present invention, since they destabilize the TCNQ radical anion due to their generally low ionization potentials.

The major advantage of a polymer/TCNQ salt composite system in which the simple salt contributes to the conductivity is that such a system requires a lower weight percent of overall TCNQ to achieve a specified resistivity than does a polymer composite system in which only the complex salt is conductive. Since high doping levels of TCNQ salt species adversely affect polymer strength, a polymer/TCNQ salt composite system in which both simple and complex salts are conductive should, at most resistivities, have a greater mechanical strength than a polymer composite system in which only the complex TCNQ salt is conductive.

OBJECTS OF THE INVENTION

It is, therefore, an object of the present invention to obtain a high electrical stability in a conductive polymeric composition.

Another object is to provide an electrically conductive polymeric composition which is highly environmentally stable and resistant to oxidation by air.

A further object of this invention is to achieve high mechanical strengths in an electrically conductive polymeric composition.

Yet another object of the present invention is to provide an electrically conductive composition which is easy to process and has excellent fiber-forming capabilities.

SUMMARY OF THE INVENTION

These and other objects are achieved by dissolving an N-methylphenazinium salt (simple or complex) of 7,7,8,8-tetracyanoquinodimethane (TCNQ) and an electron-donating polymer in a mutual solvent and casting a film from the resulting solution.

BRIEF DESCRIPTION OF THE DRAWINGS

The exact nature of this invention as well as other objects and advantages thereof will be readily apparent from consideration of the following specification and drawing in which.

DESCRIPTION OF THE PREFERRED EMBODIMENTS

Figure 1:
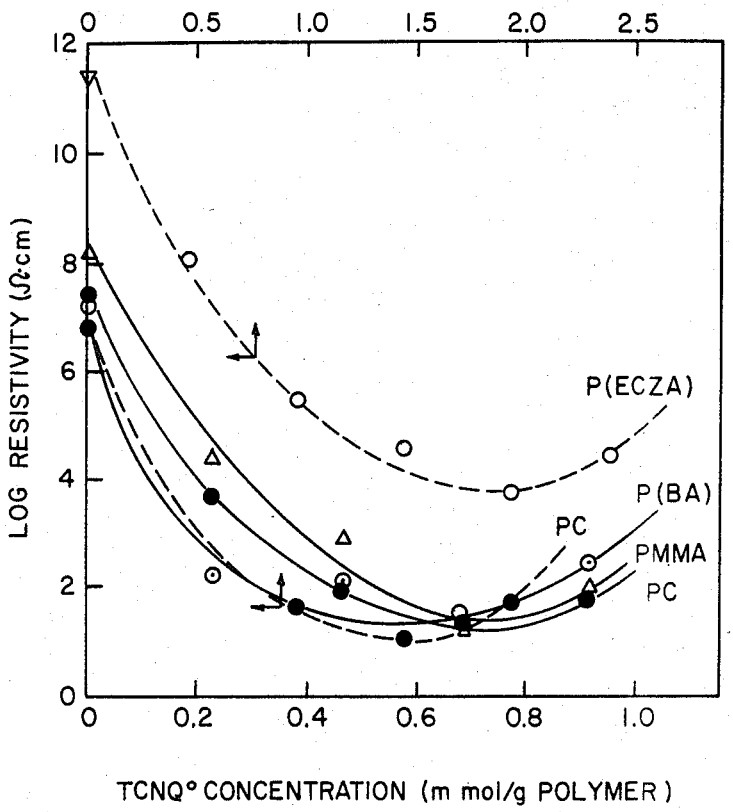
FIG. 1 is a logarithmic graph of various polymers versus the concentration of TCNQ° in the casting solution. The solid line represents an initial concentration of 0.61 mmole N-methylphenazinium TCNQ$^{\bullet-}$ salt/g polymer. The dotted line represents an initial concentration of 1.22 mmole N-methylphenazinium TCNQ$^{\bullet-}$salt/g polymer. ○ represents poly(N-ethyl-3-carbazolecarboxaldehyde (P(ECZA); • represents polycarbonate; ⊙ represents poly(vinyl butyral) (P(BA)); ▲ represents poly(methyl methacrylate) (PMMA).

To make the preferred embodiment of this invention, an electron-donating polymer, N-methylphenazinium TCNQ (simple or complex salt) and, optionally, neutral TCNQ are dissolved in an appropriate solvent to form a solution. A film is then formed cast on an appropriate substrate, such as aluminum, under reduced pressure.

In this description and the claims that follow, the terms "TCNQ salt" and "N-methylphenazinium TCNQ" refer generically to both the complex and simple salts of N-methylphenazinium TCNQ unless otherwise stated. The complex salt is designated NMP+$(TCNQ)_2^{\bullet-}$ (also $(TCNQ)_2^{\bullet-}$ salt) and the simple salt is designated NMP+TCNQ$^{\bullet-}$ (also TCNQ$^{\bullet-}$ salt). The anion of the complex salt is simply a complex of neutral TCNQ and TCNQ—, the simple radical anion (the dot represent an unpaired electron). Thus, a solution of the simple salt may be converted to a solution of the complex salt merely by the addition of TCNQ°.

Preferably, the matrix polymer is a weak electron donor. Strong electron donor polymers tend to destabilize TCNQ$^{\bullet-}$, thus inhibiting microcrystallization. To some extent, this destabilization may be overcome by the addition of neutral TCNQ°. Nevertheless, the maximum conductivity of a strong donor polymer/NMP+TCNQ$^{\bullet-}$ (or NMP+$(TCNQ))_2^{\bullet-}$ system is below that which can be achieved if a weak donor matrix polymer is used. Of course, if the ionization potential of the polymer is too high the TCNQ salt will insufficiently interact with the polymer. Thus, instead of microcrystallization, agglomeration will occur. Agglomeration of crystals would allow the matrix polymer to block conductive pathways, lowering the conductivity of the polymer/TCNQ salt system. Typically, the preferred polymers for this invention have an ionization potential of about 8–12 eV, preferably about 9–11 eV and most preferably about 9–10 eV. In order of decreasing preference, some typical polymers that may be employed in this invention are: PC; P(BA); PMMA; and P(ECZA). Of course, other matrix polymers such polyethers and polyesters having ionization potentials in about the same range as the polymers cited above should be usable as well.

Any solvent in which both N-methylphenazinium TCNQ and the chosen polymer are mutually soluble may be used in preparing this invention. Preferable solvents include dimethylformamide (DMF) and dimethylsulfoxide (DMSO). Other possible solvents include, but are not limited to N, N-dimethylacetamide, acetonitrile, tetrahydrofuran, and methylene chloride.

The conductivity of the novel films of this invention have been found to increase, up to a point, with the addition of neutral TCNQ. Conductivity is maximized when the ratio of TCNQ°/TCNQ$^{\bullet-}$ in the polymer is about equal to 1. More specifically, conductivity is maximized when all the salt in the polymer is a complex salt. It should be noted, however, that the inclusion of equal amounts of TCNQ simple salt and neutral TCNQ or only NMP+$(TCNQ)_2^{\bullet-}$ in the solution from which the TCNQ salt/polymer composite films are cast does not assure that all the TCNQ salt in the final TCNQ salt/polymer composite will be in complex salt form. Depending on the ionization potential of the polymer, varying amounts of neutral TCNQ or $(TCNQ)_2^{\bullet-}$ will associate with the polymer to form a polymer+TCNQ$^{\bullet-}$ complex. Therefore, to achieve maximum resistivity, the ratio of TCNQ°/TCNQ$^{\bullet-}$ in the solution from which the films are cast should be somewhat greater than 1. The conductivity of the system. however, decreases if excess TCNQ° is present. Further, the excess of TCNQ° is wasteful and harmful to polymer strength. Nevertheless, the polymer system of this invention would, even in the presence of excess TCNQ°, have some utility. The minimum effective amount of TCNQ° required in the system is dependent on the type of matrix polymer employed and the resistivity desired. Typically, useful conductivity occurs if the ratio of TCNQ° to TCNQ$^{\bullet-}$ is about 0.3–1.6. Somewhat higher degrees of conductivity are acheived when this ratio is about 0.7–1.3. Highest levels of conductivity are achieved when that ratio is about 0.9–1.1.

As stated earlier, the maximum conductivity of the system is achieved when all of the TCNQ salt in the polymer system is in the complex form. However, when a specific level of resistivity is desired, the preferred composition of this invention has the lowest amount of TCNQ salt in complex form necessary to achieve that resistance. In other words the weight percent of overall TCNQ salt in the system should be minimized. For example, if a certain weight percent of TCNQ salt achieves a desired resistivity when 100 percent of the salt is in the complex form, and a smaller weight percent of overall TCNQ salt species (simple and complex) acheives the same resistivity when 80 percent of the salt is in the complex form, the smaller weight percent (although a higher atomic percent of overall TCNQ salt) should be used.

In general, the films should contain about 20–90 weight percent overall TCNQ salt species. Preferably, the films should contain about 30–60 weight percent overall TCNQ salt. Most preferably, the films should contain about 50 weight percent overall TCNQ salt.

The films of this invention are characterized by a unique morphology. The SEMs in FIGS. 2b, 2c and 2d reveal that the films are actually a network of filaments. The filaments are believed to be microcrystals of TCNQ salt coated with polymer.

EXAMPLES

Poly(vinyl acetals) were synthesized from poly(vinyl alcohol) (PVA) (Poly-science, 99% saponification, molecular weight 25,000) and aldehydes such as N-ethyl 3-carbazolecarboxaldehyde (ECZA), 9-anthraldehyde (ANT), and 1-naphthaldehyde (NA). The synthetic conditions and analytical results of the poly(vinyl acetals) are given in Table I.

TABLE I

Reaction Conditions[a] and Analyses for Poly(vinyl Acetals)

| Polymer | RCHO (mol) | PVA (mol) | Acid[b] (mol) | N(%) | Acetalization[c] (%) |
|---|---|---|---|---|---|
| P(ANT) | 0.1 | 0.075 | 0.008 | [d] | 39 |
| P(ECZA) | 0.1 | 0.075 | 0.018 | 4.26[e] | 71 |
| P(NA) | 0.1 | 0.097 | 0.008 | [f] | 66 |

[a]Indicated amounts of reactants were dissolved in 130 mL of DMF and the reaction allowed to proceed for 20 h except for P(NA)(8 h).
[b]p-toluenesulfonic acid.
[c]Acetalization % = 100 [2x/(2x + y)], where x and y are the mole fractions of acetal and hydroxyl units, respectively, determined from the analyses.
[d]C, 73.37%; H, 6.66%
[e]C, 70.16%; H, 7.41%
[f]C, 75.40%; H, 6.72%

P(BA), 64% acetalization and PMMA are commercial products. A typical synthesis is represented by reaction of ECZA and PVA. The aldehyde, ECZA, 22.3 g (0.1 mol), was dissolved in 130 mL dimethylformamide (DMF) in which was suspended 3.3 g (0.075 mol) of pulverized PVA, and *p*-toluenesulfonic acid monohydrate, 2.5 g (0.013 mol,) was added. The mixture was warmed to 80° C. with stirring. In about 3 h the solution became homogeneous. After 20 h the solution was poured into a large amount of acetone to precipitate the polymer. Dissolution in DMF and precipitation with acetone and then with water was repeated several times. Finally, the precipitated polymer was filtered, washed with acetone, and dried under reduced pressure; the yield of polymer was 5 g. The nitrogen analysis, 4.26% corresponded to 71% acetalization; IR(solid film) $\nu_{CH}$: 3050, 2920, and 2870 $cm^{-1}$; $\nu_{CH}$: 1480 and 1420 $cm^{-1}$; $\nu_{COC}$: 1270 $cm^{-1}$; $\nu_{OCO}$: 1120 and 1020 $cm^{-1}$; and $\nu_{CO}$: 935 $cm^{-1}$.

Typically, the polymer, 47 mg, was dissolved in 2.0 mL dry DMF under dry nitrogen, and then a weighed amount of the simple NMP+TCNQ— was added to the solution. The dark green solution was stirred for several hours at room temperature. Films were cast from the solutions on aluminum plates at about 30° C. under reduced pressure, typically about 1–12 mm Hg. Further drying of cast films was continued overnight under vacuum. The thicknesses of the free films for the electrical measurements were in the range of $3\text{–}5\times10^{-3}$ cm.

The film was made up as a surface-type cell by vapor-depositing gold on both sides of the film. The electrical reseistance of the conductive films was determined by measuring the current under 10 V with a Keithley 610C electrometer in most cases. A four-probe method was also applied to the conductivity measurement with a Keithley 166 digital electrometer. SEMs of the conductive films were taken using an AMR Model 1000 TM scanning electron microscope.

Figure 2A:
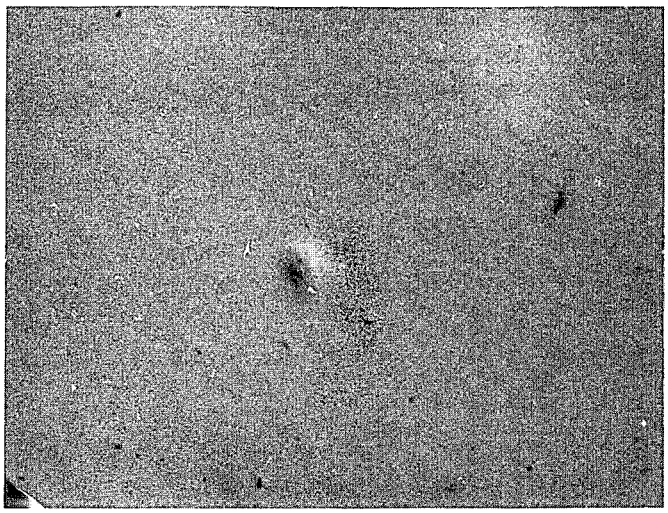
FIG. 2*a* is an scanning electron micrograph (SEM) of a polymer film produced according to this invention from a strong electron-donor polymer (P(ECZA)) employing a simple salt only and no TCNQ° (0.61 mmole N-methylphenazinium TCNQ$^{\bullet-}$ salt/g polymer).
Figure 2B:
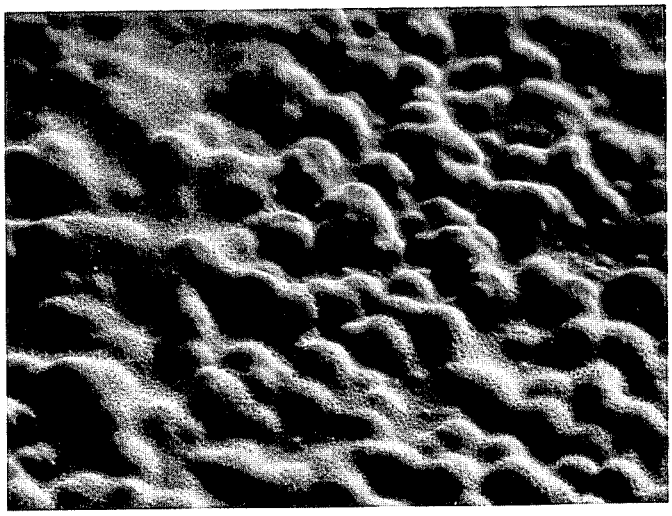
FIG. 2*b* is an SEM of a film produced according to this invention from a strong electron donating polymer (P(ECZA)) wherein TCNQ° was added to the solution from which the film was cast. (0.61 mmole N-methylphenazinium TCNQ$^{\bullet-}$ salt and 0.69 mmole TCNQ°/g polymer).
Figure 2C:
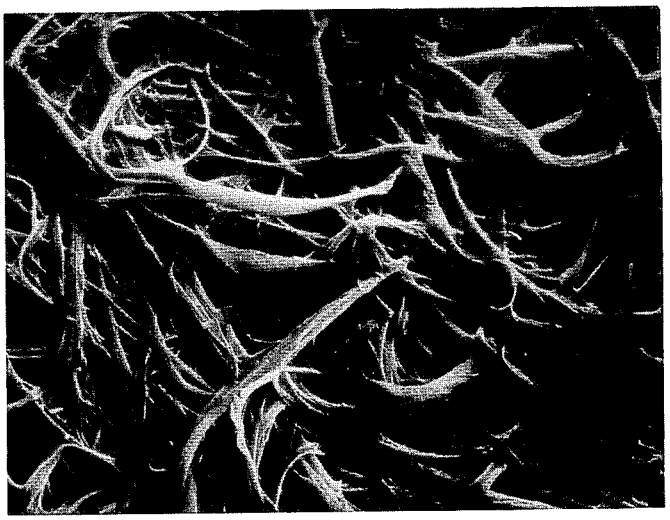
FIG. 2*c* is an SEM of polymer film produced according to this invention from a weak electron donor polymer (P(BA)) and added wherein TCNQ° was added to the solution from which the film was cast. (0.61 mmole N-methylphenazinium TCNQ$^{\bullet-}$ salt and 0.69 mmol TCNQ/g polymer).
Figure 2D:
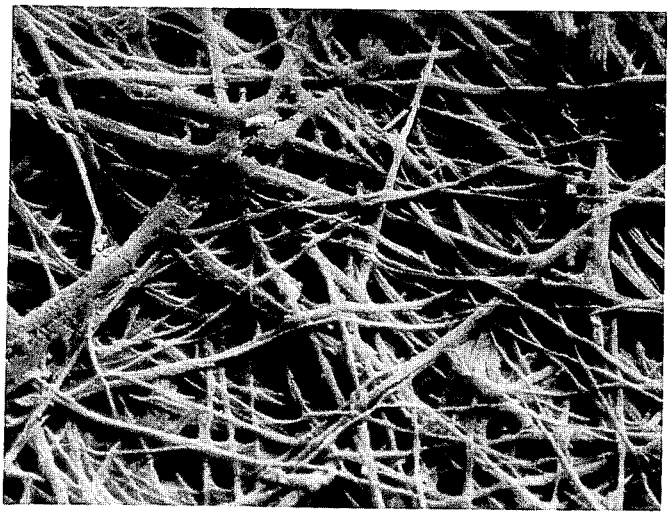
FIG. 2*d* is an SEM of a polymer film produced according to this invention from a weak electron donor polymer (polycarbonate) wherein TCNQ° was added to the solution from which the film was cast (1.22 mmole N-methylphenazinium TCNQ$^{\bullet-}$ salt and 1.38 mmole TCNQ°/g polymer).

The effect of TCNQ° doping of the NMP+TCNQ$^{\bullet-}$/polymer system was somewhat dramatic; the DMF casting solution became very stable in the presence of TCNQ°, microcrystalization of the salt was noticeable even with 30 mole % TCNQ° doping with respect to TCNQ$^{\bullet-}$ concentration, and the resistivity drop under this doping condition was four orders of magnitude lower than the undoped one. The resistivity decreased further with an additional increase of TCNQ° concentration, reaching a minimum where TCNQ°/TCNQ$^{\bullet-}$ $\simeq$1, and then tended to gradually increase with further addition of TCNQ°. As expected, the matrix effect was greater with low donor strength; weak donor polymers such as P(BA), PMMA, and PC are all far more effective than P(NA) and P(ECZA). With the former group, as shown in FIG. 1, the resistivity attained was ca. 25 (ohm-cm), at less than 30 wt % total TCNQ salt concentration in the composites, and ca. 10 (ohm-cm) at about 45 wt % total TCNQ salt; with the latter group the resistivity was ca. $10^4$ (ohm-cm) and ca. $10^3$ (ohm-cm) under the respective TCNQ salt concentrations. Controlling the rate of solvent evaporation on the film casting had no significant effect on NMP TCNQ salt micro-crystalization, while it has a marked effect on $Et_3NH^+(TCNQ)_2^{\bullet-}$ salt micro-crytalization. Throughout the optimization effort, the present composite system produced excellent conducting materials characterized by flexible film formation and high stability for over one year, in air at room temperature, the conductivity change was negligible. One interesting feature of the present composites revealed by SEM pictures (FIG. 2) is a unique film morphology showing that in the weak matrix polymers (FIGS. 2c and 2d), the TCNQ°-doped NMP+TCNQ$^{\bullet-}$ salt was recrystalized as a fully interconnected fine filamentary structure, the surface of which is fully covered along the axis by the insulating matrix polymer in a flexible manner, as if the filamentary network of the conductor were protected from the environmental change, whereas in the strong matrix polymers (FIGS. 2a and 2b), the TCNQ°-doping effect on the microcrystalization of N-methylphenazinium TCNQ is extremely slight (FIG. 2b). Furthermore, no crystalization occurred without TCNQ° doping (FIG. 2a).

Obviously many modifications and variations of the present invention are possible in the light of the above teachings. It is therefore to be understood that, within the scope of the appended claims, the invention may be practiced otherwise than as specifically described.

What is claimed and desired to be secured by Letters Patent of the United States is:

1. An electrically conductive polymeric composition comprising an electron donating polymer having an ionization potential of about 8–12 eV which is selected from the group consisting of polycarbonate, poly(vinyl butyral), poly(methyl methacrylate) and polyesters, and about 20–90 weight percent of an N-methylphenazinum TCNQ salt wherein said composition is prepared by steps comprising:

dissolving said N-methylphenazinium TCNQ salt and said polymer in a mutual solvent to form a solution; and removing said solvent.

2. The composition of claim 1 comprising 30–60 weight percent N-methylphenazinium TCNQ salt.

3. The composition of claim 2 wherein the ionization potential of said polymer is about 9–11 eV.

4. The composition of claim 3 wherein the ratio of neutral TCNQ to $TCNQ^{\bullet-}$ in said solution is about 0.3 to 1.6, wherein $TCNQ^{\bullet-}$ represents the radical anion of said N-methylphenazinium TCNQ salt and wherein the only TCNQ salt present in said solution is N-methylphenzinium TCNQ.

5. The composition of claim 1 wherein said polymer is selected from the group consisting of polycarbonate, poly(vinyl butyral), and poly(methyl methacrylate).

6. The composition of claim 5 wherein said polymer is polycarbonate.

7. The composition of claim 6 wherein the ratio of neutral TCNQ to $TCNQ^{\bullet-}$ is about 0.7–1.3.

8. The composition of claim 7 wherein the ratio of neutral TCNQ to $TCNQ^{\bullet-}$ is about 0.9–1.1.

9. The composition of claim 5 wherein said polymer is poly(vinyl butyral).

10. The composition of claim 9 wherein the ratio of neutral TCNQ to $TCNQ^{\bullet-}$ is about 0.7–1.3.

11. The composition of claim 10 wherein the ratio of neutral TCNQ to $TCNQ^{\bullet-}$ is about 0.9–1.1.

12. The composition of claim 5 wherein said polymer is poly(methyl methacrylate).

13. The composition of claim 12 wherein the ratio of neutral TCNQ to $TCNQ^{\bullet-}$ is about 0.7–1.3.

14. The composition of claim 13 wherein the ratio of neutral TCNQ to $TCNQ^{\bullet-}$ is about 0.9–1.1.

15. A method of preparing a conductive polymeric composition having a desired resistivity, the steps of which comprise:

dissolving a film-forming polymer having an ionization potential of about 8–12 eV which is selected from the group consisting of polycarbonate, poly(vinyl butyral), poly(methyl methacrylate) and polyesters, and 20–90 weight percent, based on the weight of said polymer of N-methylphenazinium TCNQ salt in a neutral solvent to form a solution;

adding a non-zero quantity of neutral TCNQ to said solution, said quantity being such that said composition prepared from said solution has said desired resistivity;

casting a film from said solution upon a substrate.

16. The method of claim 15 wherein said dissolving step comprises the step of dissolving 30–60 weight percent, based on the weight of said composition, of an N-methylphenazinium salt in said solvent.

17. The method of claim 16 further comprising the step of selecting said polymer from the group consisting of polycarbonate, poly(vinyl butyral) and poly(methyl methacrylate).

18. The method of claim 17 wherein said selecting step comprises the step of selecting poly(vinyl butrayl).

19. A method of preparing a conductive polymeric composition, the steps of which comprise;

dissolving polycarbonate and 20–50 weight percent of an N-methylphenazinium salt in a mutual solvent to form a solution;

adding a non-zero quantity of neutral TCNQ to said solution;

casting a film from said solution upon a substrate, wherein said quantity of neutral TCNQ in said solution is at least about an amount equal to that which results in said film having the maximum conductivity possible for said film given the composition of said solution prior to said adding step.

20. A conductive polymeric composition comprising a fully interconnected network of fine filaments of an N-methylphenazinium salt, each filament being fully covered along its axis by a layer of a flexible, insulating polymer, wherein said insulating polymer has an ionization potential of about 8–12 eV and is selected from the group consisting of polycarbonate, poly(vinyl butyral), poly(methyl methacrylate) and polyesters.

21. The polymeric composition of claim 20 wherein the ionization potential of said flexible, insulating polymer is about 9–11 eV.

22. The polymeric composition of claim 21 wherein said flexible, insulating polymer comprises a polymer chosen from the group consisting of polycarbonate, poly(vinylbutyral), poly(methyl methacrylate), and polyester.

23. The polymeric composition of claim 22 comprising 20–90 weight percent N-methylphenazinium TCNQ salt.

* * * * *